US009719341B2

(12) United States Patent
Johnston et al.

(10) Patent No.: US 9,719,341 B2
(45) Date of Patent: Aug. 1, 2017

(54) IDENTIFYING A TRAJECTORY FOR DRILLING A WELL CROSS REFERENCE TO RELATED APPLICATION

(75) Inventors: Lucian K. Johnston, Sugar Land, TX (US); Shahid Azizul Haq, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 835 days.

(21) Appl. No.: 12/771,230

(22) Filed: Apr. 30, 2010

(65) Prior Publication Data

US 2010/0282508 A1 Nov. 11, 2010

Related U.S. Application Data

(60) Provisional application No. 61/176,376, filed on May 7, 2009.

(51) Int. Cl.

| | |
|---|---|
| ***G06G 7/48*** | (2006.01) |
| ***E21B 44/00*** | (2006.01) |
| ***E21B 7/04*** | (2006.01) |
| ***E21B 41/00*** | (2006.01) |
| ***E21B 47/02*** | (2006.01) |
| *E21B 7/10* | (2006.01) |

(52) U.S. Cl.

CPC ..... *E21B 44/00* (2013.01); *E21B 7/04* (2013.01); *E21B 41/00* (2013.01); *E21B 47/02* (2013.01); *E21B 7/10* (2013.01)

(58) Field of Classification Search

CPC ..... E21B 7/10

USPC ..... 703/10

See application file for complete search history.

(56) References Cited

U.S. PATENT DOCUMENTS

| | | | | |
|---|---|---|---|---|
| 6,785,641 | B1 | 8/2004 | Huang | |
| 7,139,689 | B2 | 11/2006 | Huang | |
| 7,814,989 | B2 | 10/2010 | Nikolakis-Mouchas et al. | |
| 7,966,166 | B2 | 6/2011 | Thambynayagam et al. | |
| 8,237,920 | B2 * | 8/2012 | Jones et al. | 356/73 |
| 2005/0171698 | A1 * | 8/2005 | Sung et al. | 702/9 |
| 2007/0032994 | A1 * | 2/2007 | Kimminau et al. | 703/10 |
| 2007/0119244 | A1 * | 5/2007 | Goodwin et al. | 73/152.28 |
| 2007/0143023 | A1 * | 6/2007 | Betancourt et al. | 702/11 |

FOREIGN PATENT DOCUMENTS

| | | | | |
|---|---|---|---|---|
| WO | WO2006065915 | * | 6/2006 | E21B 41/00 |
| WO | WO2009/083769 A2 | | 7/2009 | |

OTHER PUBLICATIONS

Rocha et al.: Important Aspects Related to the Influence of Water Depth on ERW; IAFC/SPE 87218; pp. 1-14; Mar. 2004.*

Rocha et al.; How Water Depth Affects Extended Reach Drilling; OTC 15326; pp. 1-19; 2003.*

(Continued)

*Primary Examiner* — Hugh Jones

(57) ABSTRACT

To control well drilling, information relating to a trajectory of a well is received, and fluid flow in the well is simulated according to the received information. Simulating the fluid production comprises simulating production flow assurance that seeks to reduce occurrence of mixtures of different types of fluids that reduce production of a target fluid. In response to results of the simulating, a further trajectory for further drilling of the well is identified.

15 Claims, 5 Drawing Sheets

(56) References Cited

OTHER PUBLICATIONS

Jones et al.; Implementation of Geochemical Technology for "Real-Time" Tar Assessment and Geosteering: Saudi Arabia; Conference Proceedings Offshore Mediterranean Conference and Exhibition in Ravenna, Italy, Mar. 28-30, 2007; pp. 1-11.*
Dalia; A Supplement to E&P; Hart Energy Publishing; pp. 1-5; Mar. 2007.*
Campozana et al.; Optimization of Surface Network and Platform Location Using a Next Generation Reservoir Simulator Coupled With an Integrated Asset Optimizer—An Application to an Offshore Deep Water Oil Field in Brazil; IPTC 12500; pp. 1-7; Dec. 2008.*
Nurml; Horizontal Highlights; Middle East Well Evaluation Review; No. 16; pp. 1-19; 1995.*
Al-Umran et al.; Successful treatments to enhance the performance of horizontal wells driller near Tar-Mat Areas; IPTC 10188; pp, 1-11; 1995.*
LedaFlow, Next generation technology platform for multi-dimensional multiphase flow; SINTEF product information; pp. 1-2; Apr. 2007; pp. 1-2.*
Laux et al.; Multidimensional Simulations of Multiphase Flow for Improved Design and Management of Production and Processing Operation; OTC 19434; pp. 1-9; May 2008.*
Mantecon; The Virtual Well: Guidelines for the Application of Dynamic Simulation to Optimize Well Operations, Life Cycle Design, and Production.; SPE 109629; pp. 1-14; 2007.*
Prensky: Recent advances in LWD/MWD and formation evaluation; reprint from World Oil, Mar. 2006; pp. 1-6.*
Lenn, et al, "Horizontal Well Performance Evaluation and Fluid Entry Mechanisms," SPE 49089, 1998 SPE Annual Technical Conference and Exhibition held in New Orleans, Louisiana, Sep. 27-30, 1998, 13 pp.
Al-Ali, et al., "The Challenges of Detecting Gas Entries in Horizontal Well by Using Integrated Production Logging Tool, Case Study," SPE 65528, 2000 SPE/Petroleum Society of CIM International Conference on Horizontal Well Technology held in Calgary, Alberta, Canada, Nov. 6-8, 2000, 10 pp.

* cited by examiner

IDENTIFYING A TRAJECTORY FOR DRILLING A WELL CROSS REFERENCE TO RELATED APPLICATION

CROSS REFERENCE TO RELATED APPLICATION

This claims the benefit under 35 U.S.C. §119(e) of U.S. Provisional Application Ser. No. 61/176,376, filed May 7, 2009, which is hereby incorporated by reference.

BACKGROUND

To recover hydrocarbons or other types of fluids from subterranean reservoirs, wells are drilled through subterranean formations into such reservoirs. The drilling is typically accomplished by using a drilling assembly that is attached to a drill pipe. In addition to drilling wells to recover fluids from reservoirs, wells can also be drilled for the purpose of injecting fluids (e.g., liquids or gas) into subterranean reservoirs.

At the start of a drilling operation, a drill plan is developed, in which the trajectory of the well is planned based on existing knowledge regarding the subterranean structure acquired using various techniques, such as seismic or electromagnetic surveying, wellbore logging, and so forth. However, in many cases, the initial drill plan may not be optimal, and the well drilled according to the trajectory of this initial well plan may not allow for optimal fluid flow (e.g., fluid production or injection).

SUMMARY

In general, according to an embodiment, a method of controlling well drilling includes receiving information relating to a trajectory of a well, and simulating fluid flow in the well according to the received information. Simulating the fluid flow comprises simulating production flow assurance that seeks to reduce a multiphase holdup effect. In response to results of the simulating, a further trajectory for further drilling of the well is identified.

Other or alternative features will become apparent from the following description, from the drawings, and from the claims.

BRIEF DESCRIPTION OF THE DRAWINGS

Some embodiments of the invention are described with respect to the following figures.

DETAILED DESCRIPTION

Figure 1:
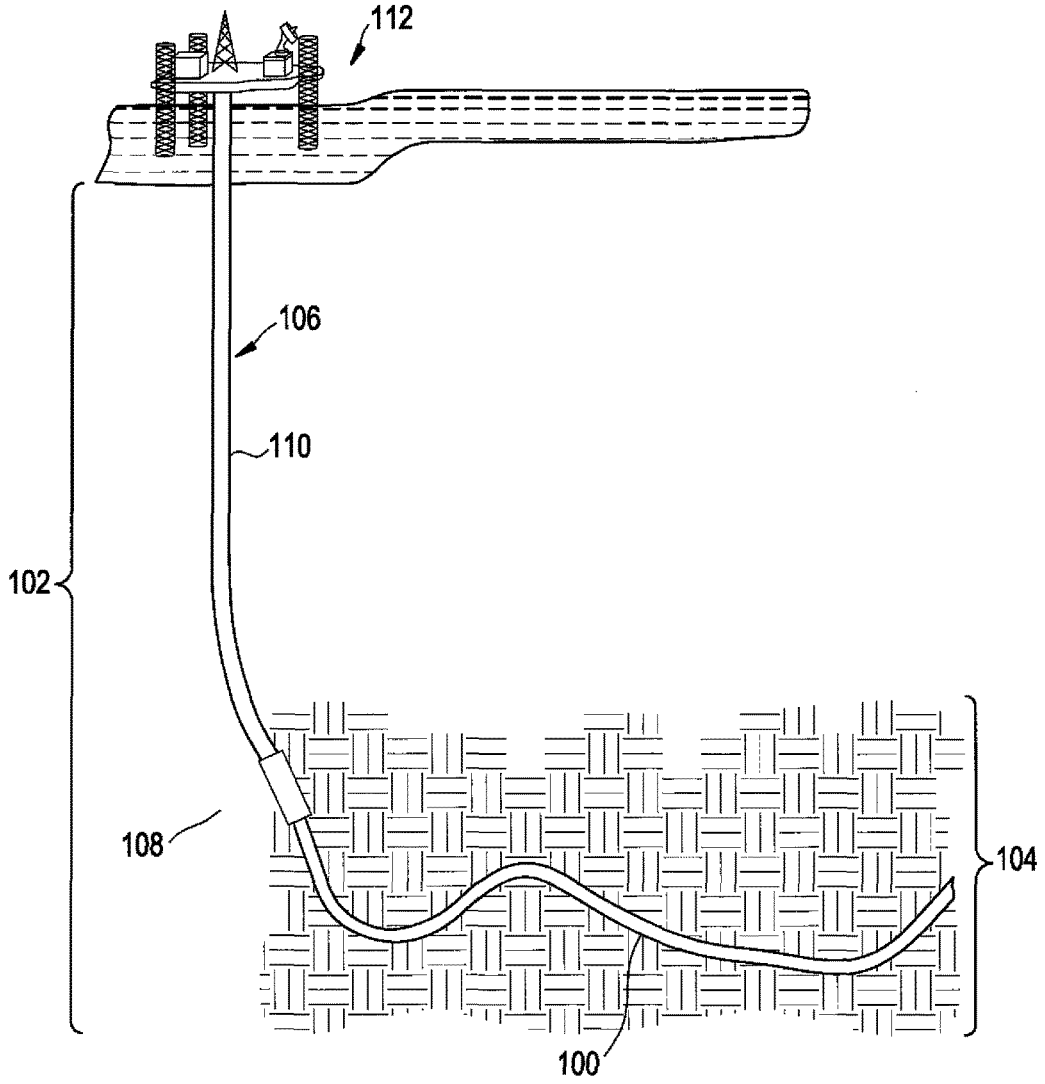
FIG. 1 is a schematic diagram illustrating an example drilling system for drilling a well into a subterranean structure.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In general, some embodiments of the present invention include methods and accompanying systems for optimization of drilling and producing a well (for example, a horizontal leg of a well) by considering the tortuosity and/or undulation effects of the well trajectory in real-time while drilling. The undulations of well trajectory in multiphase flow (flow having multiple phases of fluid) induces "three-phase holdup" and, in essence, the three-phase holdup accounts for changes in trajectory along the well path (or proposed well path) that cause reduced production due to heavier fluids building up in the lower sections (sections having greater than 90° deviation and troughs) as well as lighter fluids accumulating in the higher sections (sections less than 90° deviation and traps) of the well. The management of the three-phase holdup effect is an integral part of "flow assurance."

To begin a drilling operation, an initial well plan is generated, where the well plan defines an initial trajectory for a well. The planned trajectory may be based on incomplete information or wrong assumptions regarding the subterranean structure into which the well is to be drilled. Consequently, a well that is drilled according to this initial trajectory may not provide optimal fluid flow performance, for either fluid production or fluid injection (e.g., production of hydrocarbons or other fluids, or injection of liquids or gas).

In accordance with some embodiments, a technique is provided to allow for real-time alteration of the trajectory of the well during drilling of the well. As sections of the well are drilled, real-time information regarding the drilling is acquired, where the information regarding the drilling can include one or more of the following: measurements acquired by sensors associated with drilling equipment; information regarding the geometric position of a bottom-hole drilling assembly of the drilling equipment; and so forth. Based on the information acquired in real-time, changes to the current trajectory of the well can be proposed. Fluid flow simulations are performed based on the proposed modified trajectories of the well. Based on results of the simulations, a technique according to some embodiments determines which of the proposed modified trajectories would provide for improved (or optimal) fluid flow performance. Note that the proposed modified trajectories may not provide for improved fluid flow performance over the current trajectory, in which case the proposed modified trajectories would be discarded. However, if one of the proposed modified trajectories would provide for improved fluid flow performance, then the proposed modified trajectory would be selected for use in further drilling of the well.

The process of proposing modified trajectories and possibly selecting one of the proposed modified trajectories for further drilling are performed iteratively on a real-time basis during the well drilling operation. The process of acquiring real-time information about the drilling, proposing one or more modified well trajectories, simulating fluid flow performance based on the one or more proposed modified trajectories, and possibly selecting one of the one or more proposed modified well trajectories for further drilling, is iteratively repeated after each length of well has been drilled. In this manner, the trajectory of the well can be controlled in a real-time basis that takes into account fluid flow performance of the well as determined by simulations performed during the drilling operation.

In accordance with some embodiments, the fluid flow simulation includes three-phase holdup flow assurance simulation of fluid flow inside the well. Fluid flow assurance seeks to reduce occurrence of mixtures of different types of fluids that can reduce fluid flow performance. Note that certain mixtures of fluid can cause the viscosity of the combined fluid to be increased, which can reduce fluid flow. The term "three-phase holdup" refers to mixtures of oil, water, and gas that can increase tortuosity in the well which can interfere with optimal fluid flow performance. The three-phase holdup effect is caused by buildup of certain fluids (such as gas and water) in certain segments of the well that reduce fluid flow. The management of the three-phase holdup effect is referred to as "flow assurance."

In addition to results of the simulation that takes into account a proposed well trajectory change, other constraints are also considered in identifying a further trajectory (which may be modified from the current trajectory) to perform further drilling. Examples of such constraints include one or more of the following: structural well geometry (e.g., distance of a drilling assembly to a boundary of a reservoir, a resistivity profile, etc.); fluid distribution (e.g., porosity distribution, resistivity distribution, etc.), and other constraints.

FIG. 1 is a schematic diagram illustrating drilling of a well 100 in a subterranean structure 102. The subterranean structure 102 includes a reservoir 104 of interest, where the reservoir 104 can include fluids (e.g., hydrocarbons, fresh water, etc.) for production to the earth surface. Alternatively, the well 100 may be provided to inject fluids into the reservoir 104.

The well 100 is drilled by drilling equipment 106 that includes a bottomhole drilling assembly 108 that is carried on a drill pipe 110. The drill pipe 110 extends from a platform 112 that is located at the earth surface. In the example of FIG. 1, the platform 112 is a water surface platform. In alternative implementations, the platform 112 can be a land platform located on a land surface.

As illustrated in FIG. 1, the well 100 is associated with a trajectory inside the reservoir 104. In accordance with some embodiments, the trajectory of the well 100 is controlled on a real-time basis during drilling of the well 100 based on results of fluid flow simulations and other constraints.

Figure 2:
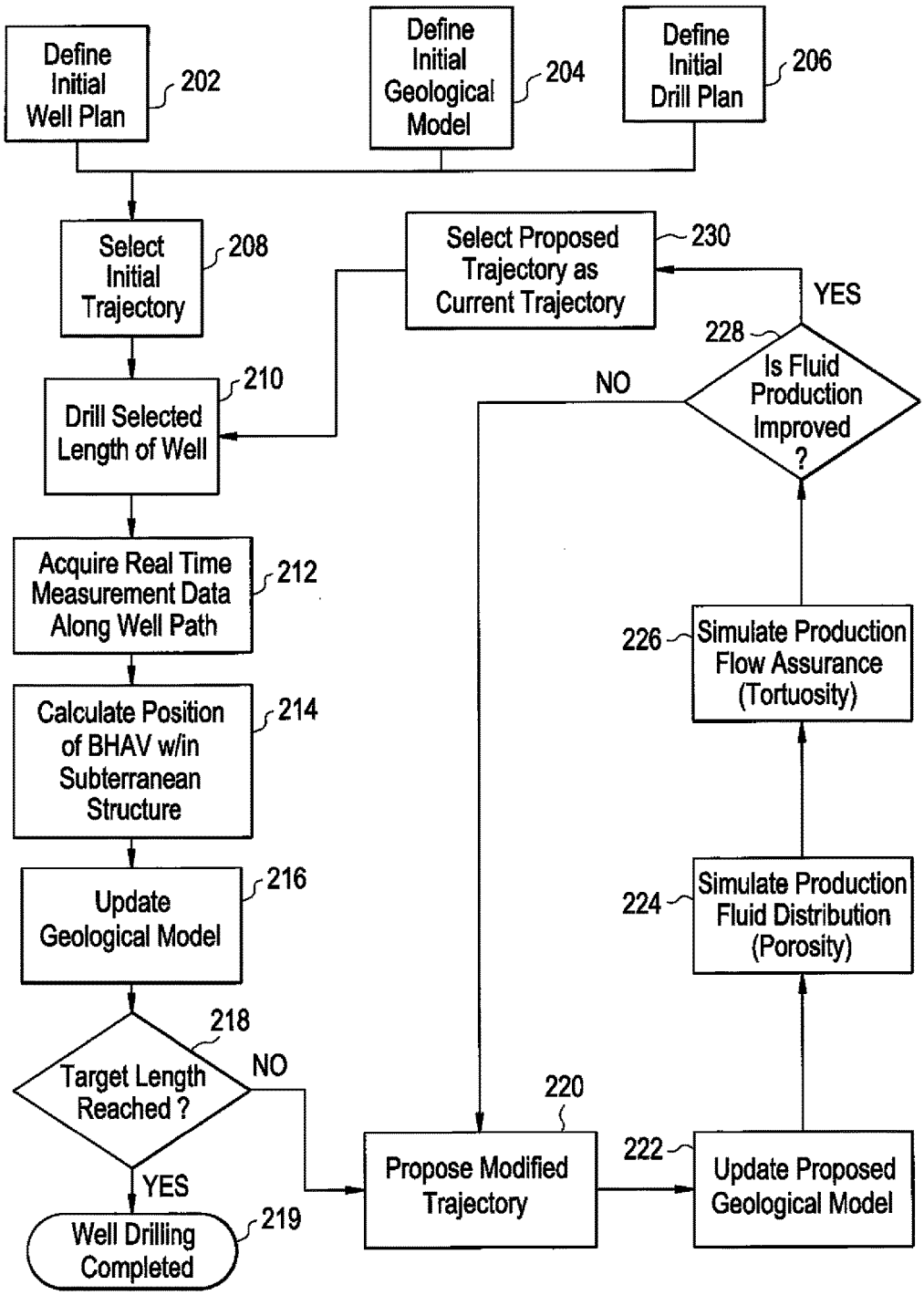
FIG. 2 is a flow diagram of a process of real-time drilling optimization, according to an embodiment.

FIG. 2 is a flow diagram of a process of performing real-time drilling optimization according to an embodiment. Initially, the process defines (at 202) an initial well plan (to define the well to be drilled and to define the location and position of the well, size of the well, and other characteristics of the well). The process also defines (at 204) an initial geological model (which represents the geologic features of the subterranean structure through which the well is to extend), and defines (at 206) an initial drill plan (which defines the type of drill assembly to use and other characteristics associated with drilling the well).

Based on the initial well plan, initial geological model, and initial drill plan, an initial trajectory for the well is selected (at 208). The initial trajectory is based on a current understanding of the subterranean structure as reflected by the initial geological model, and based on the well plan and drill plan. However, as the initial geological model may not provide an accurate representation of the physical subterranean structure through which the well is to be drilled, optimal fluid flow performance may not be achievable using a well having the initial trajectory selected at 208.

According to the current trajectory (which is the initial trajectory when the drilling operation first starts), a selected length of the well is drilled (at 210). The selected length of the well according to the current trajectory to be drilled is configurable by the drilling operator. The notion here is that after drilling each selected length of the well, the process of optimizing the well trajectory is repeated to provide for real-time alteration of the trajectory to achieve optimal (or improved) fluid flow performance. The well trajectory optimization is performed after drilling each selected length of the well and before completing the total length of the well (as defined by the well plan).

During drilling of the selected length of the well (or shortly after drilling the selected length of the well), real-time measurement data is acquired (at 212) along the well path. The acquired real-time measurement data can include resistivity data (which provides an understanding of the distribution of resistivity in the surrounding formation at the current position of the bottomhole drilling assembly), porosity data (which provides a distribution of the porosity of the surrounding formation), or other data. The real-time measurement data is acquired using one or plural sensors of the drilling equipment.

In addition, the current position of the bottomhole drilling assembly of the drilling equipment within the subterranean structure is calculated (at 214). The position of the bottomhole assembly can be calculated based on simulation performed to determine the subterranean layering in which the bottomhole assembly is located. Based on the acquired real-time measurement data, as well as the current position of the bottomhole assembly within the subterranean structure, the geological model is updated (at 216).

Next, the process determines (at 218) whether the target length of the well has been drilled. If so, drilling of the well is completed (at 219).

However, if the target length of the well has not been reached, then a modified trajectory is proposed (at 220). According to the proposed modified trajectory of the well, a proposed geological model is updated (at 222). The proposed geological model is based on the updated geological model (updated at 216), but including the well with the proposed modified trajectory.

The process then simulates (at 224) the production fluid distribution within the surrounding reservoir (proximate the bottomhole drill assembly). The production fluid distribution can be represented using porosity data representing the porosity of the surrounding reservoir at different points.

Once the simulated production fluid distribution is determined for the modified well trajectory, production flow assurance is simulated (at 226). Production flow assurance simulation involves flowing fluid from the reservoir into the well for production to the earth surface. Production flow assurance considers the three-phase holdup effect, as noted above. The modified well trajectory can include one or more traps in the well to allow for accumulation of the one or more other fluids (e.g., water or gas) with reduced interference with production of a target fluid.

The process next determines (at 228), based on the results of the production flow assurance simulation, whether fluid production is improved using the proposed modified well trajectory (as compared to the current well trajectory). If fluid production is not improved (based on output of the simulation), then another modified well trajectory can be proposed (at 220). However, if fluid production is improved, as determined at 228, then the modified well trajectory proposed at 220 can be selected as the current trajectory (at 230), and another selected length of the well is drilled (at 210) according to the new current trajectory.

In other implementations, instead of performing tasks 220-228 for just one proposed modified well trajectory, a number (which can be configurable) of proposed modified well trajectories can be proposed, with separate fluid assurance simulations performed for each of the proposed modified well trajectories. The one proposed modified well trajectory from among the number of proposed modified well trajectories that provides optimal fluid flow performance (as determined based on the simulation results) is selected to use as the current trajectory for further well drilling.

In some implementations, each iteration of drilling a further selected length of the well can involve drilling the same selected length. In alternative implementations, further drilling of selected lengths of well can use varying lengths that can be dynamically set.

The process involving tasks 210-230 as depicted in FIG. 2 is repeated until the target length of the well has been reached, as determined at 218.

Figure 3:
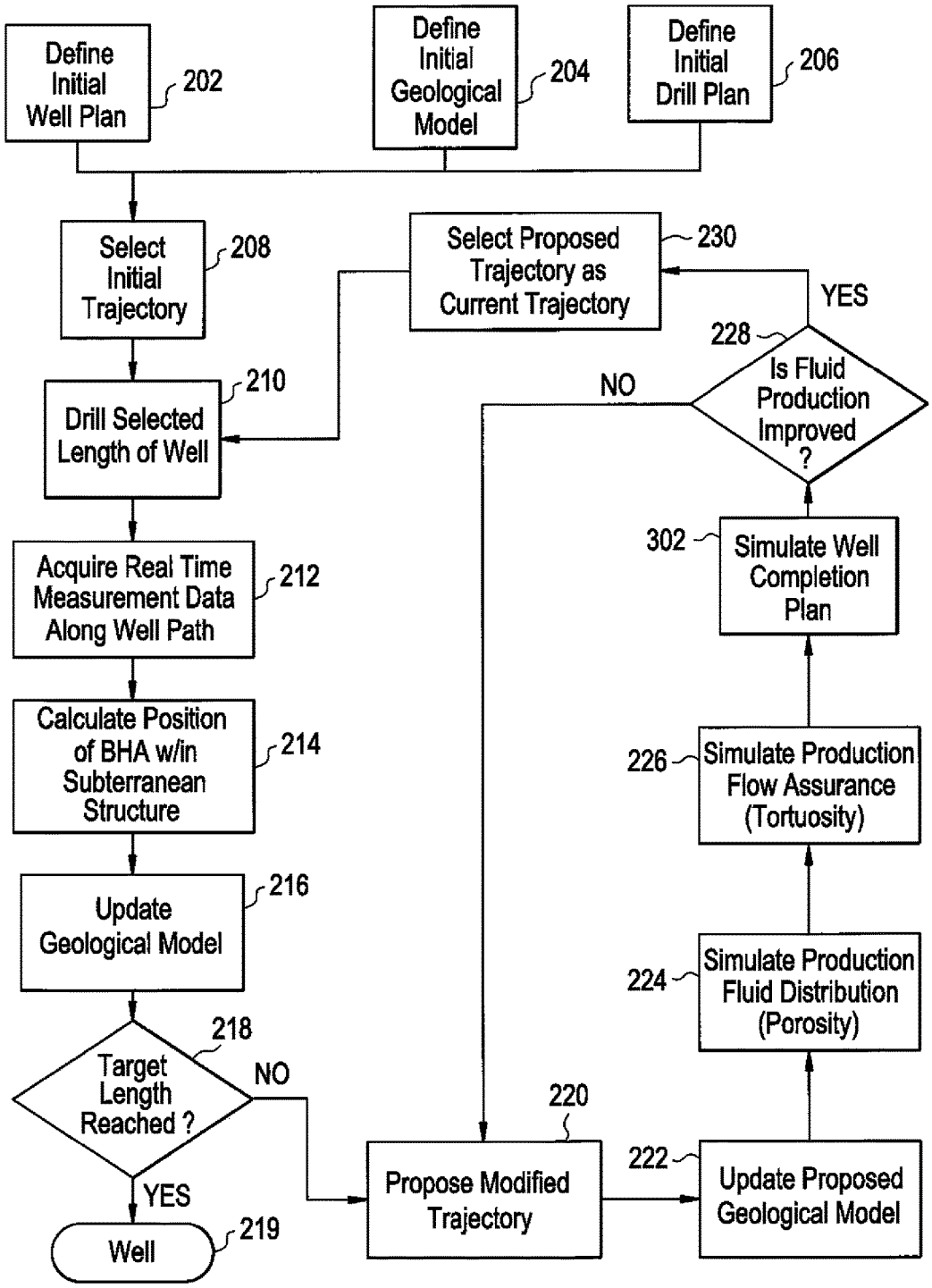
FIG. 3 is a flow diagram of a process of real-time drilling optimization, according to another embodiment.

FIG. 3 illustrates an alternative process that involves many of the same tasks as the process of FIG. 2. However, in FIG. 3, an additional task is performed after simulating production flow assurance (at 226). The FIG. 3 process further involves simulating a well completion plan (at 302) in sections of the well drilled so far. A well completion plan refers to a plan that provides equipment installed in the well to allow for production (or injection) of fluid. Examples of well completion equipment include fluid flow tubings, sealing elements such as packers, valves, sand control equipment, and so forth. Different well completion designs can be simulated to determine which design would provide for improved fluid flow performance. Thus, the FIG. 3 process would aid an operator in selecting both the optimal (or improved) well trajectory as well as the optimal (or improved) well completion equipment.

The results of each iteration of the simulation of the well completion plan are stored for later analysis to aid in selecting an optimal well completion design.

Figure 4:
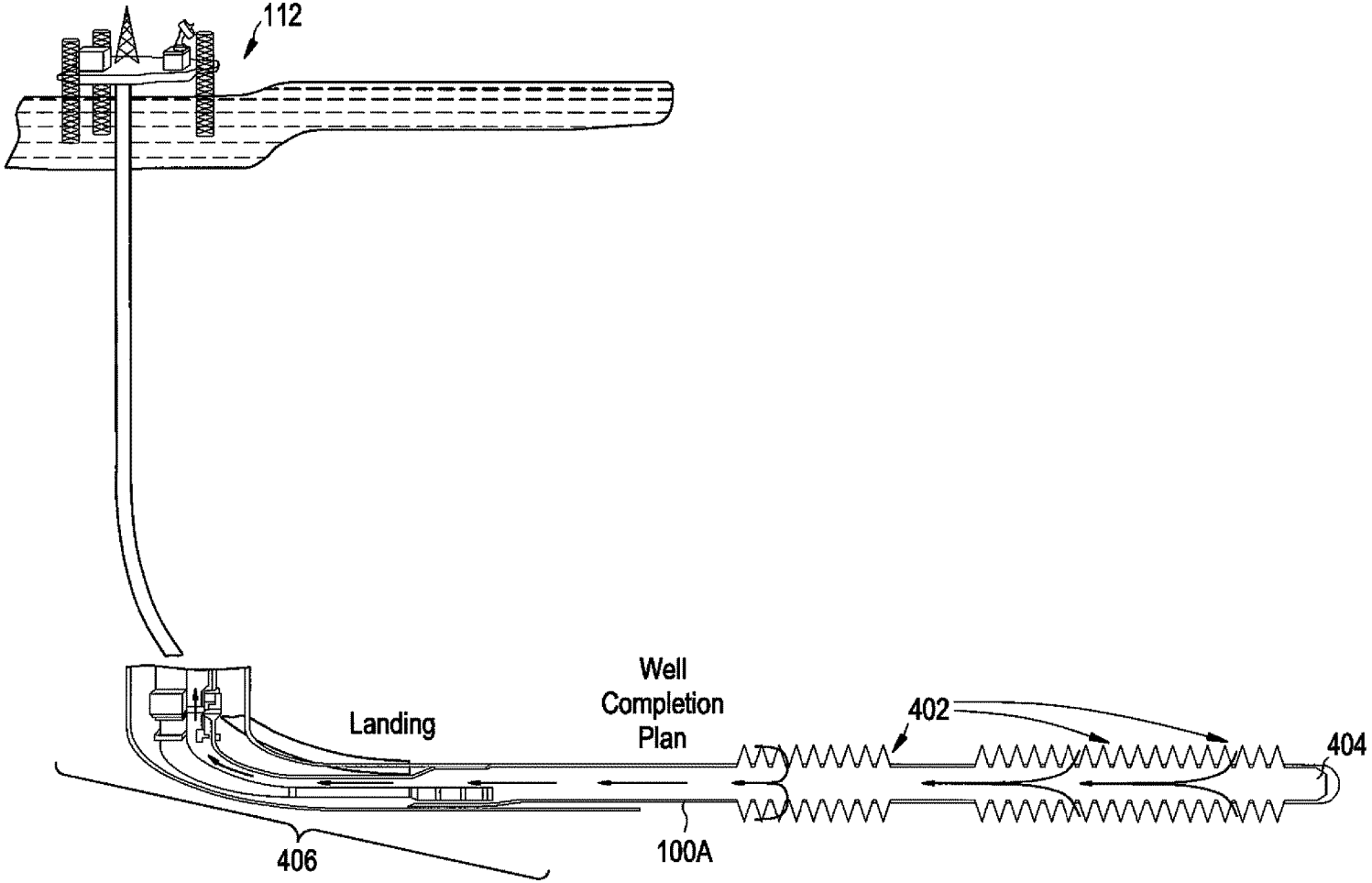
FIG. 4 is a schematic diagram that shows installation of completion equipment based on techniques according to some embodiments.

FIG. 4 illustrates a well 100A with a particular well completion plan. As shown in FIG. 4, perforations 402 are formed in a liner or casing 404 installed in the wellbore 100A. Fluid from the surrounding reservoir flows through the perforations 402 into the well. FIG. 4 further shows additional completion equipment 406 installed in the well 100A to aid in production of fluids from the surrounding reservoir through the perforations 402. Different well completion plans can be considered to determine which well completion plan would provide for improved (or optimal) fluid flow performance.

Certain of the tasks of FIGS. 2 and 3 can be performed by a computer, where a computer refers to either a single desktop or notebook computer, or to a distributed computing system having multiple computer nodes connected over a network. Examples of tasks that can be performed by a computer include, as examples, the following: 208, 214, 216, 220-230, and 302 (FIG. 2 or 3).

Figure 5:
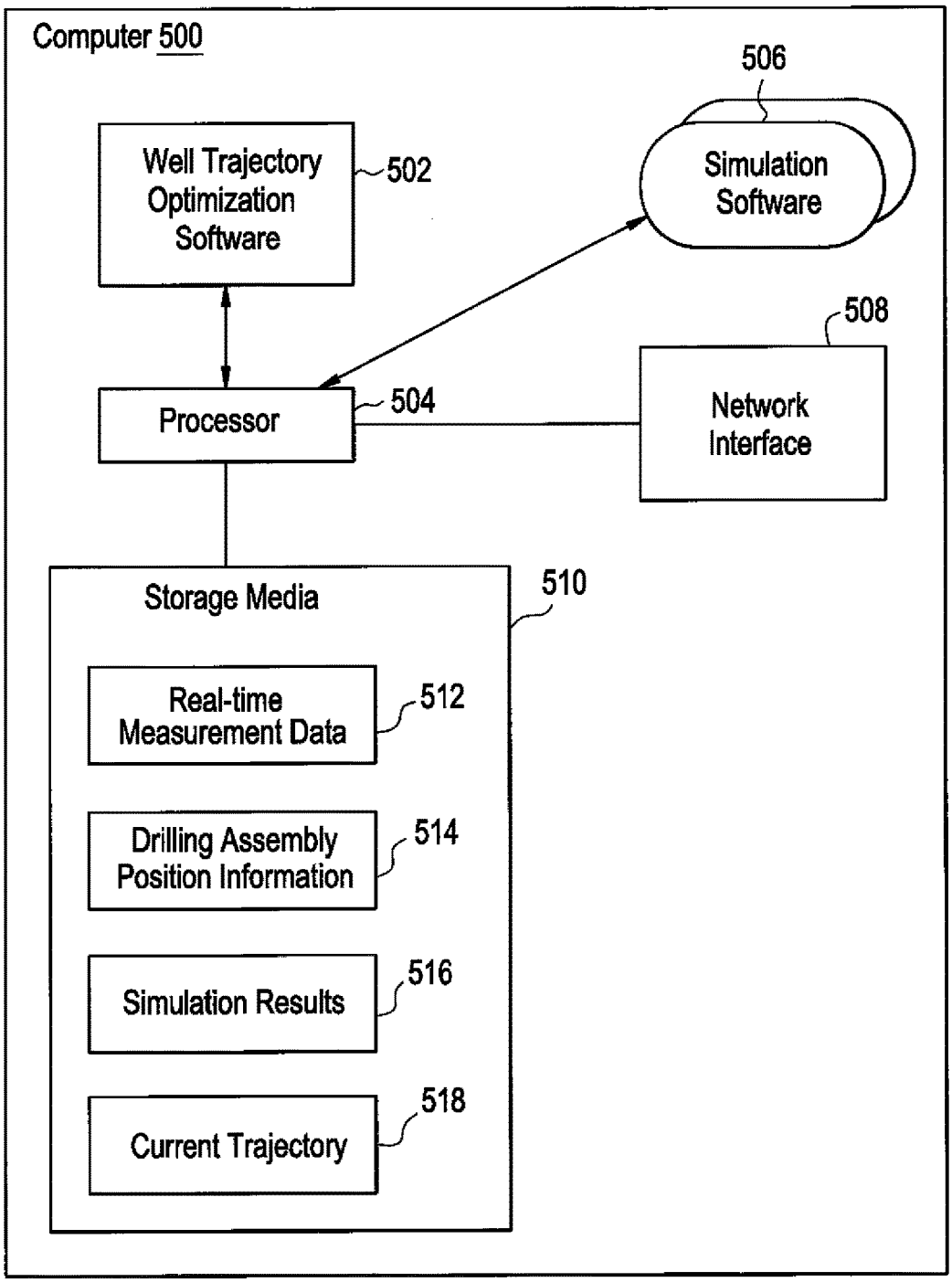
FIG. 5 is a block diagram of an example computer in which a process according to some embodiments is executable.

An example arrangement of a computer 500 is shown in FIG. 5, where the computer 500 includes well trajectory optimization software 502 that is executable on one or more processors 504. The computer 500 further includes various simulation software modules 506, which can be used to simulate production fluid distribution (224 in FIG. 2), simulate production flow assurance (226 in FIG. 2), and simulate a well completion plan (302 in FIG. 3). The simulation software modules 506 are also executable on the one or more processors 504.

The one or more processors 504 are connected to a network interface 508 to communicate with other network entities. As an example, real-time measurement data can be received through the network interface 508, where the measurement data is transmitted by downhole sensors associated with the drilling equipment.

The one or more processors 504 are connected to storage media 510, which stores real-time measurement data 512, drilling assembly position information 514, simulation results 516, and the current trajectory 518 of the well.

Instructions of software described above (including the well trajectory optimization software 502 and simulation software 506) are loaded for execution on the one or more processors 504. The processors can include microprocessors, microcontrollers, processor modules or subsystems (including one or more microprocessors or microcontrollers), or other control or computing devices. As used here, a "processor" can refer to a single component or to plural components (e.g., one CPU or multiple CPUs).

Data and instructions (of the software) are stored in respective storage devices, which are implemented as one or more computer-readable or computer-usable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs). Note that the instructions of the software discussed above can be provided on one computer-readable or computer-usable storage medium, or alternatively, can be provided on multiple computer-readable or computer-usable storage media distributed in a large system having possibly plural nodes. Such computer-readable or computer-usable storage medium or media is (are) considered to be part of an article (or article of manufacture). An article or article of manufacture can refer to any manufactured single component or multiple components.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method of controlling well drilling, comprising:
- receiving a drill plan including information relating to an initial current planned trajectory of a well;
- performing, by a computer during drilling of the well, a plurality of iterations of:
  - receiving an altered planned trajectory of the well that differs from the current planned trajectory of the well;
  - updating a geological model based on the altered planned trajectory of the well;
  - simulating, based on the updated geological model, fluid flow in the well according to the altered planned trajectory for further drilling of the well, wherein simulating the fluid flow comprises simulating production flow assurance that considers occurrence of mixtures of different types of fluids that reduce production of a target fluid;

in response to determining from results of the simulating that the altered planned trajectory provides improved fluid flow characteristics, identifying the altered planned trajectory as an updated current planned trajectory to use for further drilling of the well; and performing the further drilling of the well according to the updated current planned trajectory.

2. The method of claim 1, wherein the received altered planned trajectory is a selected one of a plurality of proposed altered planned trajectories.

3. The method of claim 1, wherein the receiving the altered planned trajectory, the updating, the simulating, the identifying, and the performing the further drilling are iteratively performed to complete drilling of the well.

4. The method of claim 3, wherein receiving the altered planned trajectory of the well occurs after a partial length of the well has been drilled but before a total length of the well has been drilled, and wherein the simulating and the identifying are performed prior to the total length of the well being drilled, and wherein the further drilling is performed after the partial length of the well has been drilled.

5. The method of claim 1, wherein simulating the fluid flow comprises simulating fluid production in the well from a reservoir surrounding the well to an earth surface from which the well extends.

6. The method of claim 5, wherein the occurrence of the mixtures of different types of fluids that reduce production of the target fluid is part of a three-phase holdup effect.

7. The method of claim 5, wherein simulating the production flow assurance comprises identifying one or more sections of the well in which buildup of one or more fluids other than the target fluid occur.

8. The method of claim 7, wherein the altered planned trajectory includes one or more traps in the well to allow for accumulation of the one or more other fluids with reduced interference with production of the target fluid.

9. An article comprising at least one non-transitory computer-readable storage medium storing instructions that upon execution cause a computer to:

receive a drill plan including information of an initial current planned trajectory of a well, wherein the initial current planned trajectory of the drill plan is based on a geological model;

during drilling of the well, perform a plurality of iterations of:

receive information relating to the drilling, the received information comprising measurement data acquired by one or more sensors of drilling equipment during the drilling, and a current position of the drilling equipment;

receive a proposed planned trajectory of the well that differs from the current planned trajectory of the well;

change the geological model responsive to the measurement data to produce an updated geological model;

modify the updated geological model based on the proposed planned trajectory to produce a modified geological model, the modified geological model including a well according to the proposed planned trajectory;

prior to completion of the drilling of the well, simulate, using the modified geological model, fluid flow in the well in response to the proposed planned trajectory, wherein simulating the fluid flow comprises simulating production flow assurance that considers a multiphase holdup effect; and in response to determining from results of the simulating that the proposed planned trajectory provides improved fluid flow characteristics, identify the proposed planned trajectory to update current planned trajectory to use for further drilling of the well to provide for real-time trajectory control in drilling the well.

10. The article of claim 9, wherein simulating the production flow assurance considers occurrence of mixtures of different types of fluids that reduce production of a target fluid.

11. The article of claim 9, wherein simulating the production flow assurance comprises identifying one or more sections of the well in which buildup of one or more fluids other than a target fluid occur, and wherein the proposed planned trajectory comprises one or more traps in the well to allow for accumulation of the one or more other fluids with reduced interference with production of the target fluid.

12. A computer comprising:

storage media to store information relating to drilling of a well, and information of a drill plan that specifies an initial current planned trajectory of the well, wherein the initial current planned trajectory is based on a geological model; and one or more processors configured to, during drilling of the well, perform a plurality of iterations of:

receive information relating to the drilling;

receive a proposed modified planned trajectory of the well that differs from the current planned trajectory of the well;

change the geological model responsive to measurement data acquired by one or more sensors during the drilling of the well, the changing to produce an updated geological model;

modify the updated geological model based on the proposed modified planned trajectory to produce a modified geological model, the modified geological model including a well according to the proposed modified planned trajectory;

prior to completion of the drilling of the well, simulate, using the modified geological model, fluid flow in the well in response to the proposed modified planned trajectory, wherein simulating the fluid flow comprises simulating production flow assurance that considers occurrence of mixtures of different types of fluids that reduce production of a target fluid; and in response to determining from results of the simulating that the proposed modified planned trajectory provides improved fluid flow characteristics, identify the proposed modified planned trajectory to update the current planned trajectory to use for further drilling of the well to provide for real-time trajectory control in drilling the well.

13. The article of claim 9, wherein receiving the information, receiving the proposed planned trajectory, simulating the fluid flow, and identifying the proposed planned trajectory to use for further drilling are iteratively performed until the completion of the drilling of the well.

14. The computer of claim 12, wherein receiving the information, receiving the proposed modified planned trajectory, simulating the fluid flow, and identifying the proposed modified planned trajectory to use for further drilling are iteratively performed until the completion of the drilling of the well.

15. The article of claim 9, wherein the instructions upon execution cause the computer to further:

in response to determining from the results of the simulating that the proposed planned trajectory does not provide improved fluid flow characteristics, identify a different proposed planned trajectory as the updated current planned trajectory to use for further drilling of the well.

* * * * *